United States Patent [19]

Uhle

[11] Patent Number: 4,595,157

[45] Date of Patent: Jun. 17, 1986

[54] CONTROL SYSTEM PARTICULARLY FOR WINGLESS GUIDED AMMUNITION

[75] Inventor: Heiko Uhle, Egmating, Fed. Rep. of Germany

[73] Assignee: Messerschmitt-Bölkow-Blohm GmbH, Fed. Rep. of Germany

[21] Appl. No.: 523,430

[22] Filed: Aug. 16, 1983

[30] Foreign Application Priority Data

Aug. 25, 1982 [DE] Fed. Rep. of Germany ..... 3231528

[51] Int. Cl.[4] ..... F41G 9/00; F42B 25/24

[52] U.S. Cl. ..... 244/3.22; 102/384

[58] Field of Search ..... 244/3.22, 3.1; 102/384

[56] References Cited

U.S. PATENT DOCUMENTS

| | | | |
|---|---|---|---|
| 2,726,510 | 12/1955 | Goddard | 244/3.22 |
| 3,599,899 | 8/1971 | McCullough | 244/3.22 |
| 3,806,063 | 4/1974 | Fitzgerald | 244/3.22 |
| 4,211,378 | 7/1980 | Crepin | 244/3.22 |

FOREIGN PATENT DOCUMENTS

| | | | |
|---|---|---|---|
| 1147144 | 4/1963 | Fed. Rep. of Germany | 244/3.22 |
| 2444920 | 4/1975 | Fed. Rep. of Germany . | |
| 2815087 | 10/1978 | Fed. Rep. of Germany . | |
| 2757664 | 6/1979 | Fed. Rep. of Germany . | |

*Primary Examiner*—Charles T. Jordan

*Attorney, Agent, or Firm*—McGlew and Tuttle

[57] ABSTRACT

A control system for an ammunition having a longitudinal axis and adapted to move in a flight direction, particularly a wingless ammunition falling in ballistic flight, comprises a body having a rear curved surface with a gas generator in the body for producing gas under pressure. A nozzle is mounted to the body and oriented to direct a gas jet produced from the pressurized gas rearwardly and tangentially over the curved surface with respect to the flight direction of the ammunition. The gas jet produces reduced pressure on its side of the ammunition to alter the flight thereof.

4 Claims, 3 Drawing Figures

CONTROL SYSTEM PARTICULARLY FOR WINGLESS GUIDED AMMUNITION

FIELD AND BACKGROUND OF THE INVENTION

The present invention relates in general, to flight controls for a projectile and, in particular to a new and useful control system for a preferably wingless guided piece of ammunition.

Such a guided ammunition usually comprises a more or less compact ammunition body without wings or fins, which moves in a ballistic flight while rotating about its longitudinal axis. To be able to guide such an ammunition during the flight toward a point to be hit, devices for varying the trajectory of the ammunition are needed.

German OS No. 28 15 087 discloses a projectile control particularly for artilliry or a rocket, for correcting the trajectory of the projectile by a controlled sideward discharge of gas jets. In addition to a power source delivering a gas stream to a plurality of discharge apertures arranged over the periphery of the projectile, a distributor is provided by which the gas stream is split and directed into enlarging conduits. The reaction control is effected either by enlarging or contracting the discharge apertures, or by varying the intensity of the discharged jets. The discharge apertures through which the gas jets are expelled are so arranged at the outer surface of the projectile that the resultant of the forces thereby produced passes through the center of gravity of the projectile.

Such a control system is expensive in manufacture, sensitive to disturbances, and suitable only for controlling rockets, at most.

Also known from German OS 07 57 664 is a device for varying the trajectory of a projectile, comprising a pulse jet rocket engine oriented in the axial direction of the projectile and equipped with at least one nozzle directed at an angle to the projectile axis, for producing pulses in a line passing through the center of gravity of the projectile. The nozzle ends of the combustion chambers of the jet engine are located at the point of the projectile. In this system which is suitable particularly for fin-stabilized projectiles, the trajectory is varied by controllably opening the nozzles and igniting the jet engine. This reaction control requires a pulse jet rocket engine occupying a large part of the available ammunition space.

Further, German AS No. 11 47 144 discloses a jet propulsion missile equipped with jet nozzles which are disposed in planes passing through the axis of the missile, at an angle to this axis. To pivot them and thus correct the trajectory, the nozzles or their parts are connected to a control mechanism. By increasing the angle of the nozzle jets at one side of the projectile axis and reducing it or keeping it unchanged at the other side, a torque is produced for changing the trajectory. The nozzle control mechanism is expensive and requires much space.

SUMMARY OF THE INVENTION

The present invention is directed to a control system, particularly for wingless guided ammunition, which is less expensive, simpler and more effective than the prior art systems.

Accordingly, an object of the present invention is to provide a control system for an ammunition having a longitudinal axis and adapted to move in a flight direction, comprising, a body having a rear curved surface, means for supplying gas in the body, at least one nozzle mounted to the body and connected to the means for supplying gas via a control valve, for generating a gas jet, the nozzle oriented at a flat angle to the surface for directing its gas jet rearwardly with respect to the flight direction and substantially tangentially over the curved surface whereby the flight path of the ammunition can be altered.

Another object of the invention is to provide a method of controlling an ammunition having a body with a longitudinal axis and adapted to move in the direction of this axis comprising a nozzle on the body oriented to direct the gas stream tangentially and rearwardly over a rear curved surface of the body, supplying the nozzle with gas to produce the gas jet and moving the ammunition in its flight direction.

Thus, according to the invention, the projectile on a ballistic trajectory is guided into the target by blowing pressure gas in a controlled manner tangentially over the curved surface. Since this circulation flow produced by blowing is superposed on the air flow caused by the ballistic flight, an underpressure is produced at the respective projectile side, which is an aerodynamic control force acting in the desired direction.

By providing a suitable shape and nozzle arrangement, a pressure distribution over the surface is obtained such that the resultant produced by the air pressure passes approximately through the center of gravity of the missile.

The inventive control has the advantage that by properly varying the flow past the missile, a pressure distribution on the missile surface, or an aerodynamic force, is produced acting in the control direction in addition to the jet reaction. As compared to a mere reaction control, a relatively small gas pressure is utilized more efficiently, so that either the effect of the control can be increased, or the gas generator can be reduced in size.

A further object of the invention is to provide a control system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the following, one embodiment of the invention is explained in more detail with reference to the accompanying drawings in which.

DESCRIPTION OF THE PREFERRED EMBODIMENTS

Figure 1:
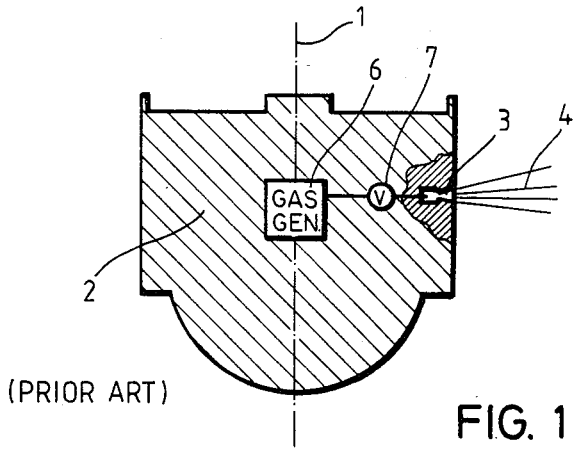
(PRIOR ART) FIG. 1
FIG. 1 is a sectional view of a prior art reaction-controlled ammunition body.

FIG. 1 illustrates a compact prior art ammuntion body 2 which rotates about an axis 1 when in ballistic flight. Body 2 accommodates a gas generator 6 which is connected to at least one nozzle 3. To vary the trajectory of the body during its ballistic flight, pressure gas 4 is periodically blown through nozzle 3 in a manner controlled by a valve 7. In the shown example of FIG. 1, the control jet pushes the prior art ammunition body to the left as it drops in its flight path.

Figure 2:
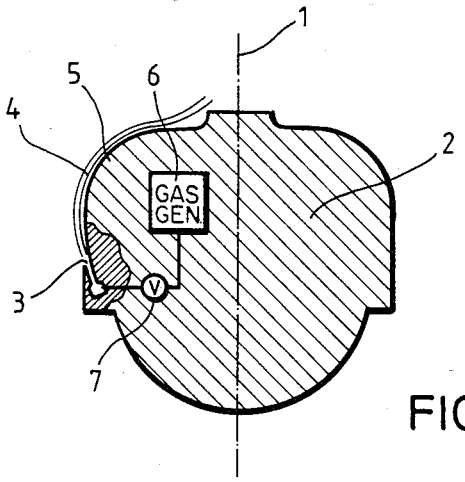
FIG. 2 is a similar view of an inventive ammuntion body with a circulation control.

The inventive design is illustrated by FIG. 2 where similar numbers designate similar parts. A jet nozzle 3 is provided at the periphery of ammunition body 2 in such orientation that the gas jet 4 is directed tangentially to the surface 5 of body 2, substantially opposite the flight direction, thus upwardly in the figure, with the surface 5 of body 2 having a curved configuration in the zone between nozzle 3 and its rear end. Due to the so-called Coanda effect, the gas jet 4 follows the contour 5, which is preferably continuously curved, of the rear portion of ammunition body 2, until it breaks away.

The superimposition of the provided circulation flow on the air flow caused by the flight produces an underpressure at the ammunition body side where the nozzle jet is provided, thus an aerodynamic pressure toward that side (to the left in FIG. 2).

The inventive contour is particularly effective if the ammunition body is so compact in shape that the flow breaks away at the rear portion and forms "dead air". In such a case, the gas jet displaces the break-away location unilaterally downstream, which results in a particularly large change in the pressure distribution to produce a control force as desired. This makes it possible to obtain a stronger control effect with a gas generator of the same size as in the prior art reaction control, or to reduce the size of the gas generator while obtaining the same control effect as in the prior art and saving space for a larger explosive charge.

The invention is not limited to ammunition rotating about its longitudinal axis, and may be applied as well to non-rotating ammunition such as to bodies which are dropped in slow descent of a balloon-parachute. In such a case, a plurality of jet-nozzles must be distributed at the periphery, to be able to correct the path of descent in any direction.

Figure 3:
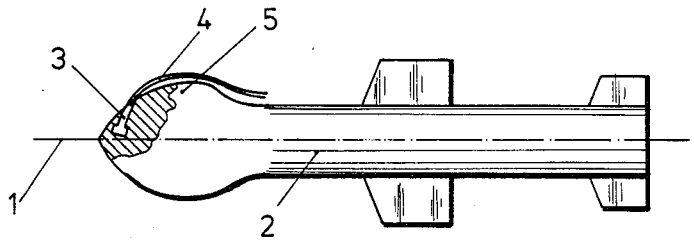
FIG. 3 is a side view of a guided missile with the inventive control system.

Further, the invention is not strictly limited to wingless guided ammunition. It may also be used for producing control forces at the nose of a finned guided missile shown in FIG. 3, where again like numbers designate similar parts.

While a specific embodiment of the invention has been shown and described in detail to illustrate the application of the principles of the invention, it will be understood that the invention may be embodied otherwise without departing from such principles.

What is claimed is:

1. A control system for an ammunition having a longitudinal axis and adapted to move in a flight direction, comprising:

a body having a rear curved surface and a center of gravity;

means for supplying gas in said body;

at least one nozzle mounted to said body and connected to said means for supplying gas, for generating a gas jet, said nozzle oriented so as to direct the gas jet rearwardly toward and substantially tangentially over said rear curved surface with respect to the flight direction whereby the gas jet in conjunction with the ambient air flow moving over the curved surface produces reduced pressure for controlling the flight direction, said nozzle being positioned so that a resultant force of the reduced pressure passes approximately through the center of gravity of the body; and said longitudinal axis comprises an axis of rotation for said body in its flight direction, said means for supplying gas including valve means for periodically supplying gas to said at least one nozzle.

2. A control system according to claim 1, wherein said rear curved surface extends downstream from said at least one nozzle continuously and convexly.

3. A control system for wingless guided ammunition having a body with a center of gravity, comprising at least one pressure gas producer and at least one jet nozzle provided at a periphery of the anmunition body, said jet nozzle being oriented relative to an air flow direction or longitudinal axis of the ammunition body, and a flat angle such that a gas jet from said nozzle is directed rearwardly tangentially to an outer surface of the ammunition body, between said jet nozzle and a rear end thereof, which is curved convexly, said nozzle positioned to produce a resultant produced pressure force approximately passing through the center of gravity.

4. A method of controlling an ammunition flying in a flight path, which ammunition comprises a body having a longitudinal axis and a center of gravity, means for supplying gas in the body and a nozzle mounted on the body and connected to the means for supplying gas, comprising:

orienting the nozzle so that a gas jet produced by the nozzle is discharged at a flat angle to at least one of the flight path and longitudinal axis, rearwardly over a surface of the body with respect to the flight path;

providing a surface of the body rearwardly of the nozzle with a convexly curved configuration from the nozzle to a rear end of the ammunition;

supplying pressurized gas from the means for supplying gas to the nozzle through a control valve for producing the gas jet whereby a reduced pressure is produced in the vicinity of the gas jet for regulating the flight path, the nozzle being positioned so that resultant force due to the reduced pressure passes approximately through the center of gravity; and causing the ammunition to rotate about the longitudinal axis and periodically supplying pressurized gas to the nozzle for periodically producing gas jets.

* * * * *